United States Patent [19]

Asanae et al.

[11] 4,231,320

[45] Nov. 4, 1980

[54] MAGNETIC BRUSH-TONER SUPPLY HOPPER

[75] Inventors: Masumi Asanae, Kamugaya; Keitaro Yamashita, Kamisato, both of Japan

[73] Assignee: Hitachi Metals, Ltd., Tokyo, Japan

[21] Appl. No.: 23,002

[22] Filed: Mar. 22, 1979

[30] Foreign Application Priority Data

Mar. 23, 1978 [JP] Japan ..... 53-33531

[51] Int. Cl.[3] ..... G03G 15/09

[52] U.S. Cl. ..... 118/657

[58] Field of Search ..... 118/644, 653, 657, 658; 427/14.1; 430/122; 101/1 NQ; 355/3 DD

[56] References Cited

U.S. PATENT DOCUMENTS

| | | | |
|---|---|---|---|
| 3,152,924 | 10/1964 | Wanielista et al. | 118/657 |
| 4,081,571 | 3/1978 | Nishihama et al. | 118/653 |
| 4,100,884 | 7/1978 | Mochizuki et al. | 118/658 X |
| 4,154,520 | 5/1979 | Nishikawa et al. | 427/14.1 X |

*Primary Examiner*—Morris Kaplan

*Attorney, Agent, or Firm*—Finnegan, Henderson, Farabow, Garrett & Dunner

[57] ABSTRACT

A magnetic brush having an independently rotatable non-magnetic core is disposed in the mouth of a toner supply tank. An upper tank wall and a top portion of the sleeve form a delivery gap and a bottommost tank wall section with the sleeve bottom forms a toner return gap which is disposed in a vertical plane whereby unused toner enters the supply tank in a horizontal direction.

3 Claims, 1 Drawing Figure

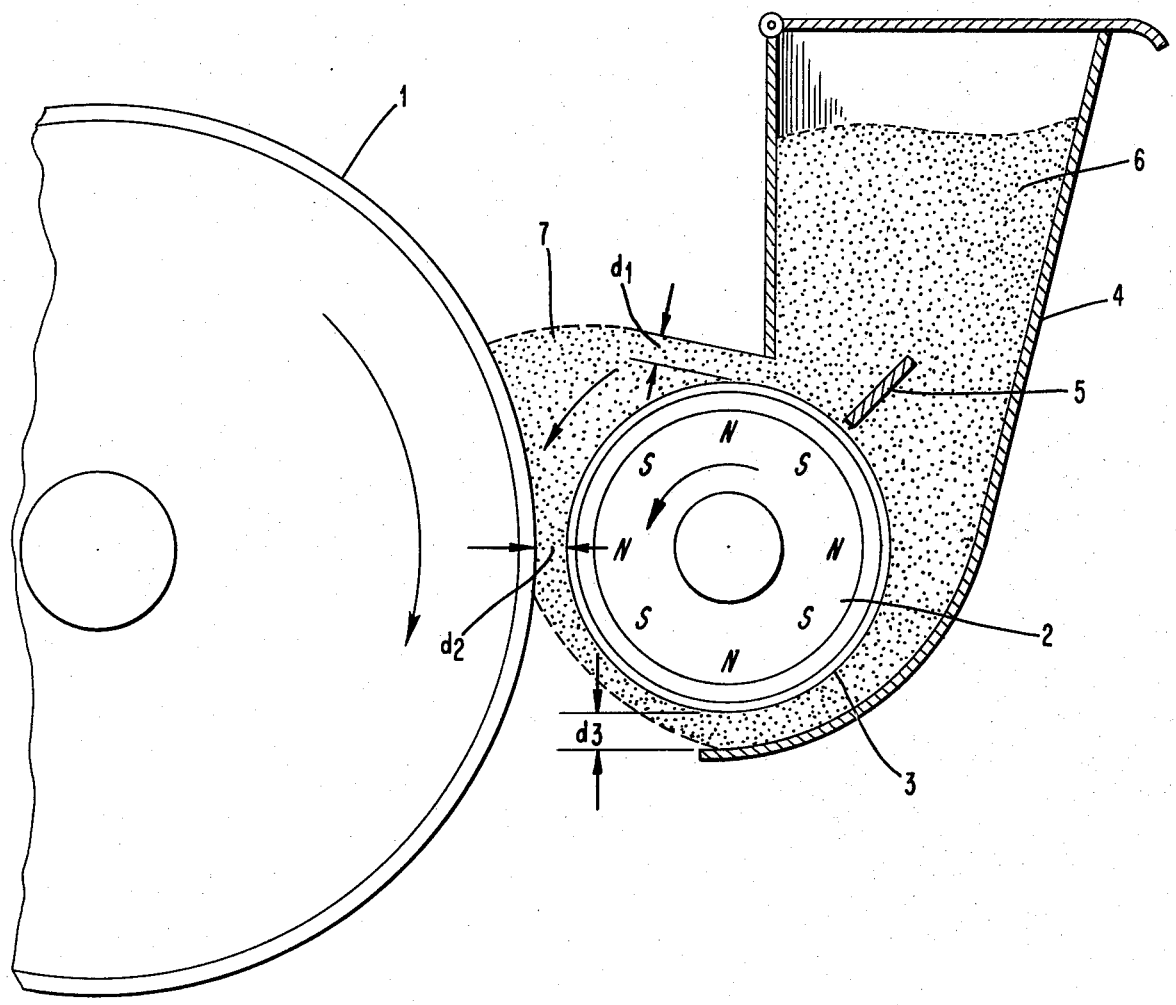
1
7
d1
6
4
5
N
S
S
N
N
S
S
N
2
d2
d3
3

MAGNETIC BRUSH-TONER SUPPLY HOPPER

FIELD OF THE INVENTION

This invention relates to electrostatic copying apparatus and, more particularly, to devices for supplying magnetic toner in such apparatus.

BACKGROUND OF THE INVENTION

In electrostatic copying apparatus, it is now conventional to use a rotatable magnet roll, coaxial with a surrounding rotatable non-magnetic shell, for transporting magnetic toner from a toner supply to a development area and for further transporting unused toner through a development gap between the shell and an image-bearing drum, on around the shell and magnet roll and back to the toner supply.

It is also known to maintain the toner supply in a tank having a substantial opening in the bottom into which the shell and magnet roll protrude. In such an arrangement, the magnetic toner passes through at least three gaps in which the nonmagnetic shell forms one surface: (1) a gap between the end of an upper wall of the toner tank and the shell for drawing out toner from the tank onto the surface of the non-magnetic shell; (2) a gap between the image-bearing drum and the shell forming a portion of the development area; and (3) a gap between the end of a lower wall of the toner tank and the shell for drawing unused toner back into the toner supply tank. The ends of the upper wall and the lower wall form the opening in the tank into which the shell and magnetic roll partially protrude.

In this type of arrangement however, the magnetic toner tends to leak through the gaps between the walls of the tank and the non-magnetic drum when new toner is being supplied to the tank. The leakage is particularly troublesome as to the gap between the lower wall of the tank and the shell, when the shell and the magnet roll are stationary.

SUMMARY OF THE INVENTION

It is, therefore, the principal object of the invention to provide toner supply apparatus of the type described above in which there is no leakage through the gaps between the walls of the toner supply tank and the non-magnetic shell while new toner is being supplied to the tank.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the gap between the lower wall of the toner supply tank and the shell for drawing unused toner back into the tank is made smaller than the maximum transportation depth for magnetic toner on the shell and greater than the gap between the upper wall of the toner supply tank and the cylindrical shell for drawing toner out of the tank. The terminology "maximum transportation depth," as used in this specification, means a toner depth within which toner on the shell is able to be transported without falling from the shell under the force of gravity. Excess of toner over this depth will fall from the shell.

The accompanying drawing, which is incorporated in and constitutes a part of the specification, illustrates one embodiment of the invention and, together with the description, serves to explain the principles of the invention.

BRIEF DESCRIPTION OF THE DRAWING

The FIGURE is a schematic cross-sectional view of toner supply apparatus incorporating the preferred embodiment of the invention.

DESCRIPTION OF THE PREFERRED EMBODIMENT

Reference will now be made in detail to the present preferred embodiment of the invention, an example of which is illustrated in the accompanying drawing wherein are shown a light-sensitive drum 1, a magnetic roll 2, a non-magnetic cylindrical shell 3, a toner supply tank 4, a cleaning bar 5 and magnetic toner 6. In the illustrated embodiment, the magnet roll 2 and the cylindrical shell 3 rotate in a same direction, that is, counterclockwise, as shown, and the light-sensitive drum 1 rotates clockwise. The cylindrical shell 3, with its coaxial magnet roll 2, is disposed in an opening in the toner supply tank 4 and its cylindrical surface partially protrudes into the toner supply tank 4.

Two gaps are formed between the cylindrical shell 3 and the toner supply tank 4, in which the width of the upper gap is represented by $d_1$ and the width of the lower gap is represented by $d_3$. The gap between the light-sensitive drum 1 and the cylindrical shell 3 is represented by $d_2$. The width $d_1$ and the width $d_2$ are approximately the same and the width $d_3$ is made smaller than the maximum transportation depth for magnetic toner on the cylindrical shell 3 and greater than the width $d_1$. In this apparatus, the maximum transportation depth is observed to be 8 to 10 mm.

The magnetic toner 6 in the toner supply tank 4 is drawn out through the upper gap $d_1$ and transported in a counterclockwise direction by way of the cylindrical shell 3. As is now well-known in the art, a magnet roll having elongated magnets spaced about its periphery parallel to its axis and with alternating polarity tends to rotate the bipolar magnetic toner particles on the non-magnetic cylindrical shell. If the shell is held stationary, the toner particles roll along the surface of the shell in the direction opposite to the direction of rotation of the magnetic roll. If, however, as in the illustrated embodiment, the magnet roll and cylindrical shell are both rotated in the same direction, the net movement of the magnetic toner is in the same direction of rotation as the magnet roll and shell.

The term "net movement" is used as to the toner around the shell, since there is a tendency for the toner to move in the opposite direction from the direction of rotation of the magnet roll and shell where the depth of the toner is such that the magnetic force on the toner and the friction drag of the cylindrical shell are not sufficient to transport the toner in the direction of rotation of the magnet roll and shell. This phenomenon will be discussed in more detail at a later point in the disclosure.

As the magnetic toner 6 is transported along the surface of the shell, an accumulation 7 of toner is formed between the light-sensitive drum 1 and the cylindrical shell 3. The magnetic toner 6 in the toner accumulation 7 reaches a depth in which the rotation of the toner particles carries the outer layer in the opposite direction to that of the toner close to the shell 3. For this reason, the toner particles in the accumulation 7 flow circularly in a clockwise direction and thereby softly contact the surface of the light-sensitive drum 1.

The net movement of the magnetic toner 6, however, is counterclockwise through the development zone and the gap $d_2$. The unused toner passes through the gap $d_2$ and is transported in a much reduced thickness counterclockwise and is drawn back into the toner supply tank 4 through the gap $d_3$.

Again in the supply tank 4, the toner 6 close to the cylindrical shell 3 continues to be drawn counterclockwise, but the toner particles farther away from the shell move clockwise causing a circulation of toner in the supply tank. Since the magnetic toner 6 in the toner supply tank 4 is always kept agitated in such a manner, the magnetic toner is prevented from coagulating.

The magnetic toner, however, sometimes coagulates on the cylindrical shell 3. In order to remedy this, a bar 5 is disposed in the supply-tank 4 closely adjacent to the cylindrical shell 3. The bar 5 scrapes off any magnetic toner 6 coagulated on the cylindrical sleeve 3. The magnetic toner 6 thus scraped off joins the supply of toner in the tank 4 and is subject to the counterclockwise and clockwise forces as described above.

A specific embodiment of toner supply apparatus for an electrostatic developing machine is given as follows:

- light-sensitive drum: selenium drum, circumferential speed about 100 mm/sec;
- cylindrical shell: stainless steel 32 mm in outside diameter, rotational speed about 70 r.p.m;
- magnet roll: isotropic barium ferrite 29 mm in outside diameter, number of poles 8, rotational speed about 1200 r.p.m;
- magnetic flux density at the surface of the shell of about 500 gauss;
- magnetic toner: 60% magnetite and the balance resin and carbon, specific volume resistivity of about $10^{12}\Omega$. cm:
- gap $d_1$:0.5 mm;
- gap $d_2$:0.6 mm;
- gap $d_3$:4 mm; and maximum magnetic transportation depth on the cylindrical shell about 8 mm.

By thus making the width for the lower gap $d_3$ smaller than the maximum transportation depth for magnetic toner on the cylindrical shell 3, leakage of the magnetic toner 6 through the lower gap $d_3$ can be eliminated. In addition, by making the width $d_3$ greater than the width $d_1$, undesired formation of toner accumulation can be prevented at the draw-in gap $d_3$. Upon supply of toner from above the toner supply tank 4 at a time when the magnet roll 2 and the cylindrical shell 3 are stationary, leakage through the gaps between the walls of the toner supply tank and the shell is prevented, and any resulting toner barrier at the gap $d_3$ avoided. Avoidance of toner leakage by means of the present invention is especially beneficial in the developer apparatus shown in the FIGURE wherein the plane of gap $d_3$ is vertically oriented and the unused toner is returned to the supply tank 4 in a horizontal direction.

As apparent from the above description according to the present invention, magnetic toner supply apparatus for an electrostatic developing machine can be obtained having advantageous features such as of simple structure, low cost fabrication and wide utility.

What is claimed is:

1. A developing machine for magnetic toner having a toner supply tank with an opening, a rotatable non-magnetic cylindrical shell disposed in said opening, its cylindrical surface partially protruding into the toner supply tank and a rotatable magnet roll disposed in said cylindrical shell, said magnet roll being adapted to rotate for drawing magnetic toner out of said toner supply tank, transporting the magnetic toner around said cylindrical shell to contact a support for electrostatic latent images and then drawing unused toner again into the toner supply tank, characterized in that the width of a first gap between a wall of the toner supply tank and the cylindrical shell for drawing unused magnetic toner back into the tank is made smaller than the maximum transportation depth for magnetic toner on the cylindrical shell and greater than both the width of a second gap between a wall of the toner supply tank and the cylindrical shell for drawing magnetic toner out of the supply tank and also the width of a third gap between the latent image support and the cylindrical shell, leakage through said first gap between the wall of the toner supply tank and the shell being prevented when the magnet roll and cylindrical shell are stationary, the plane defined by said first gap being oriented vertically at the bottom of the shell and wherein said unused toner drawn back into the toner supply tank through said first gap enters said first gap in a horizontal direction.

2. The developing machine for magnetic toner as defined in claim 1, wherein the cylindrical shell and the magnet roll rotate in the same direction.

3. The developing machine for magnetic toner as defined in claim 1 or 2, wherein a bar is provided in the toner supply tank closely adjacent to the cylindrical shell and spaced from said first gap and said second gap, said bar for scraping coagulated magnetic toner off the shell.

* * * * *